US007810441B2

(12) United States Patent
Swanson et al.

(10) Patent No.: US 7,810,441 B2
(45) Date of Patent: Oct. 12, 2010

(54) COAL BURNER ASSEMBLY

(75) Inventors: Malcolm L. Swanson, Chickamauga, GA (US); Michael S. Swanson, Chickamauga, GA (US); Russell W. Fountain, East Ridge, TN (US); William Eric Wattenbarger, Attalla, AL (US); Andrew Hobbs, Sheffield (GB); Kelly Knight, Ringgold, GA (US)

(73) Assignee: Astec, Inc., Chattanooga, TN (US)

( * ) Notice: Subject to any disclaimer, the term of this patent is extended or adjusted under 35 U.S.C. 154(b) by 728 days.

(21) Appl. No.: 11/880,316

(22) Filed: Jul. 20, 2007

(65) Prior Publication Data

US 2008/0280242 A1 Nov. 13, 2008

Related U.S. Application Data

(60) Provisional application No. 60/832,445, filed on Jul. 21, 2006.

(51) Int. Cl.
*F23K 3/02* (2006.01)
*F23D 1/00* (2006.01)

(52) U.S. Cl. ..... 110/104 B; 110/263; 110/260

(58) Field of Classification Search ..... 110/104 B, 110/260, 261, 263, 264, 265; 431/8, 9, 350, 431/181, 187, 349, 278, 284, 285, 143, 247, 431/248; 60/749

See application file for complete search history.

*Primary Examiner*—Kenneth B Rinehart
*Assistant Examiner*—David J Laux
(74) *Attorney, Agent, or Firm*—Chambliss, Bahner & Stophel, P.C.

(57) ABSTRACT

A burner assembly including a housing having an air inlet, a burner end having an opening, a longitudinal axis extending generally from the air inlet toward the burner end, a motor, an impeller mounted in the housing and being in fluid communication with the air inlet, operatively connected to the motor and adapted to direct air from the air inlet toward the burner end, a coal tube adapted to convey coal toward the burner end, a coal inlet adapted to convey coal to the coal tube, a first bluff body ring, a second bluff body ring and a third bluff body ring mounted at the burner end, a flame bridge disposed between the first bluff body ring and the second bluff body ring, and an igniter mounted in the burner end and being adapted to ignite the air and fuel mixture in the burner end to produce a main flame.

20 Claims, 7 Drawing Sheets

COAL BURNER ASSEMBLY

CROSS-REFERENCES TO RELATED APPLICATIONS/PATENTS

This application relates back to and claims priority from U.S. Provisional Patent Application Ser. No. 60/832,445 filed on Jul. 21, 2006 and entitled "Coal Burner Plant."

FIELD OF THE INVENTION

The present invention relates generally to burner assemblies for heating and drying aggregate materials, and particularly to burner assemblies that are adapted to fire on coal for heating and drying aggregate materials used in connection with the production of hot mix asphalt.

BACKGROUND AND DESCRIPTION OF THE PRIOR ART

It is known to use burner assemblies to heat and dry aggregate materials used in connection with the production of hot mix asphalt. Conventional burner assemblies used in connection with the production of hot mix asphalt, however, suffer from one or more disadvantages. For example, conventional coal burners do not inject coal into the burner such that wear is minimized. Conventional coal burners do not uniformly mix air and coal dust because such burners swirl the air/coal mixture in order to stabilize the main flame. In addition, the swirl produced by conventional coal burners contributes to the excessive abrasive wear on the components of the burners.

It would be desirable, therefore, if an apparatus could be provided that would inject coal into a coal burner such that wear to the components of the burner is minimized. It would also be desirable if such an assembly could be provided that would uniformly mix air and coal dust. It would be further desirable if such an assembly could be provided that would produce a stable main flame without swirling the air or coal in the coal burner.

ADVANTAGES OF THE PREFERRED EMBODIMENTS OF THE INVENTION

It is an advantage of the preferred embodiments of the invention described and claimed herein to provide a coal burner assembly adapted for use in connection with the production of hot mix asphalt. It is also an advantage of the preferred embodiments of the invention to inject coal into a coal burner assembly such that wear to the components of the burner assembly is minimized. It is a further advantage of the preferred embodiments of the invention to provide a coal burner assembly that uniformly mixes air and coal dust. It is a still further advantage of the preferred embodiments of the invention to provide a coal burner assembly that produces a stable main flame without swirling the air or coal in the coal burner assembly.

Additional advantages of the preferred embodiments of the invention will become apparent from an examination of the drawings and the ensuing description.

SUMMARY OF THE INVENTION

The invention comprises a burner assembly including a housing having an air inlet, a burner end having an opening, a longitudinal axis extending generally from the air inlet toward the burner end, a motor, and an impeller mounted in the housing and being in fluid communication with the air inlet, operatively connected to the motor and adapted to direct air from the air inlet towards the burner end. The burner assembly also includes a coal tube adapted to convey coal toward the burner end, a coal inlet adapted to convey coal to the coal tube, a first bluff body ring mounted at the burner end, a second bluff body ring mounted at the burner end, a third bluff body ring mounted at the burner end, and at least one flame bridge disposed between the first bluff body ring and the second bluff body ring. The burner assembly further includes an igniter mounted in the burner end and being adapted to ignite the air and fuel mixture in the burner end to produce a main flame.

In the preferred embodiments of the burner assembly, the coal tube is disposed substantially parallel to the longitudinal axis of the burner assembly, the coal inlet is disposed substantially perpendicular to the coal tube, and the at least one flame bridge extends radially from the first bluff body ring toward the second bluff body ring. Also in the preferred embodiments, the burner assembly includes a flame retention cone having a diverging angle of at least approximately 45° relative to the longitudinal axis of the burner assembly and a cylindrical portion mounted in the burner end and having a jog. The preferred embodiments of the burner assembly further include an atomizing nozzle, at least one gas injection nozzle, at least one screen and a coal tube band.

BRIEF DESCRIPTION OF THE DRAWINGS

The presently preferred embodiments of the invention are illustrated in the accompanying drawings, in which like reference numerals represent like parts throughout, and in which.

DESCRIPTION OF THE PREFERRED EMBODIMENTS OF THE INVENTION

Figure 1:
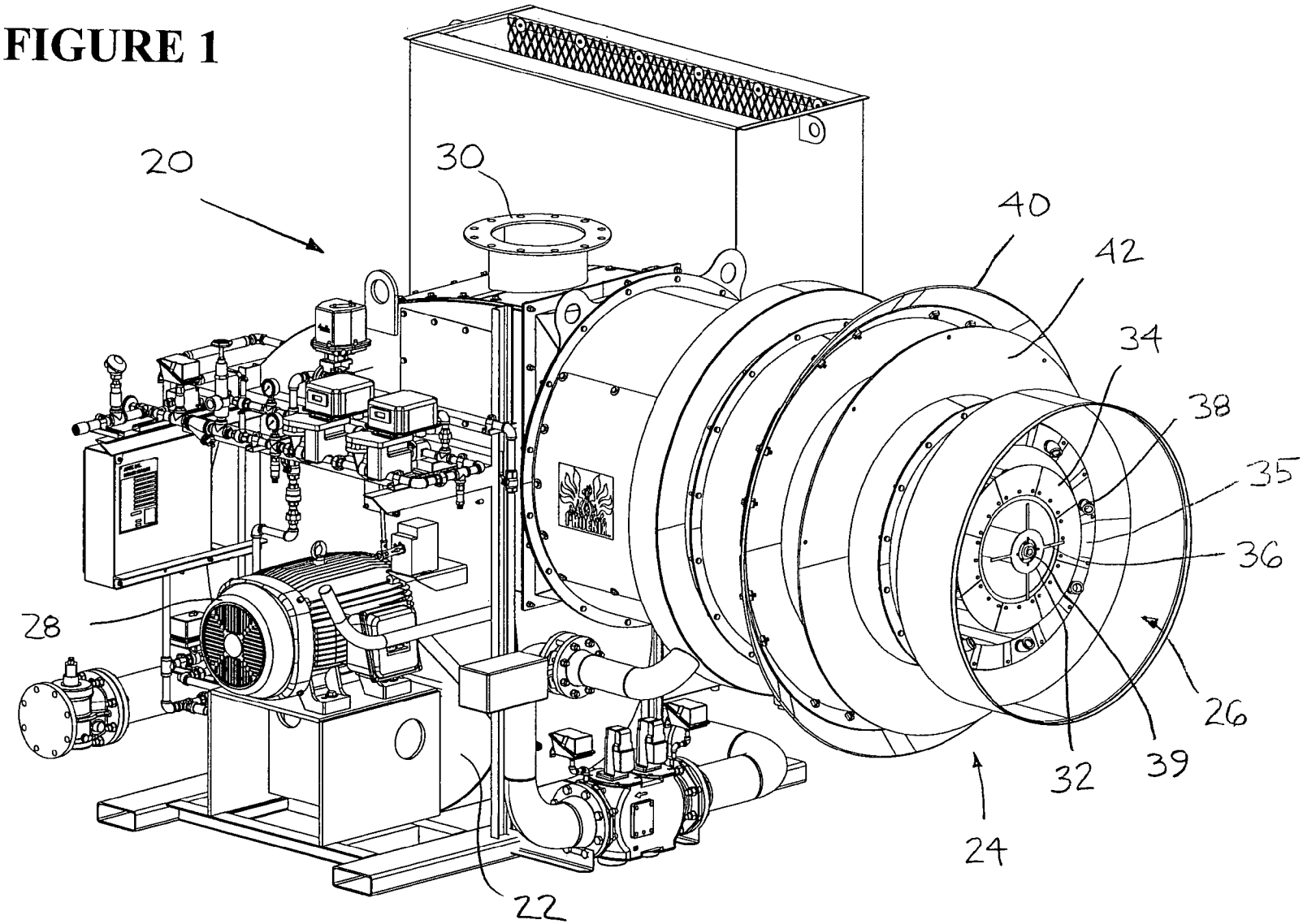
FIG. 1 is a perspective view of the preferred embodiment of the coal burner assembly in accordance with the present invention.

Referring now to the drawings, the preferred embodiment of the coal burner assembly in accordance with the present invention is illustrated by FIGS. 1 through 7B. As shown in FIGS. 1-7B, the preferred coal burner assembly is designated generally by reference numeral 20. The preferred coal burner assembly 20 is an auxiliary fuel supported burner. More particularly, when the preferred coal burner assembly 20 is firing coal, it is adapted to also fire an amount of gas and/or liquid fuel such as oil to enhance flame stability and promote higher quality combustion. In the preferred embodiments of coal burner assembly 20, the amount of gas or liquid fuel used to enhance flame stability and promote higher quality combustion is minimal. The preferred coal burner assembly 20 burns both coal and the support fuels (e.g., gas or liquid fuel) in the nozzle mix mode such that there is little or no mixing of fuel with air inside the burner body. The preferred coal burner assembly 20 is adapted to fire on coal and one support fuel. It is contemplated within the scope of the invention, however, that the coal burner assembly may be adapted to simultaneously fire on coal and more than one support fuel. It is also contemplated within the scope of the invention that the coal burner assembly may be adapted to fire on one or more support fuels without coal.

Referring now to FIG. 1, a front perspective view of the preferred coal burner assembly 20 is illustrated. As shown in FIG. 1, the preferred coal burner assembly 20 comprises housing 22 and burner end 24 having opening 26. The preferred burner assembly 20 also includes a motor such as variable speed motor 28, coal inlet 30 which is adapted to convey coal to the coal tube (see FIGS. 4-6), first bluff body ring 32 which is mounted at the burner end, second bluff body ring 34 which is mounted at the burner end, and third bluff body ring 35 which is mounted at the burner end. The preferred burner assembly 20 further comprises at least one flame bridge 36 which is disposed between first bluff body ring 32 and second bluff body ring 34. In addition, preferred burner assembly 20 includes a plurality of gas injection nozzles 38 which are mounted at the burner end and adapted to convey gaseous fuel, and atomizing nozzle 39 which is mounted on the liquid fuel guide tube (see FIGS. 4-6). Further, the preferred coal burner assembly 20 includes seal skirt 40 which is mounted adjacent to the burner end and adapted to prevent air from entering a dryer drum (not shown) and heat shield 42 which is mounted adjacent to the burner end and adapted to be attached to a dryer drum and prevent air from entering the dryer drum.

Figure 2:
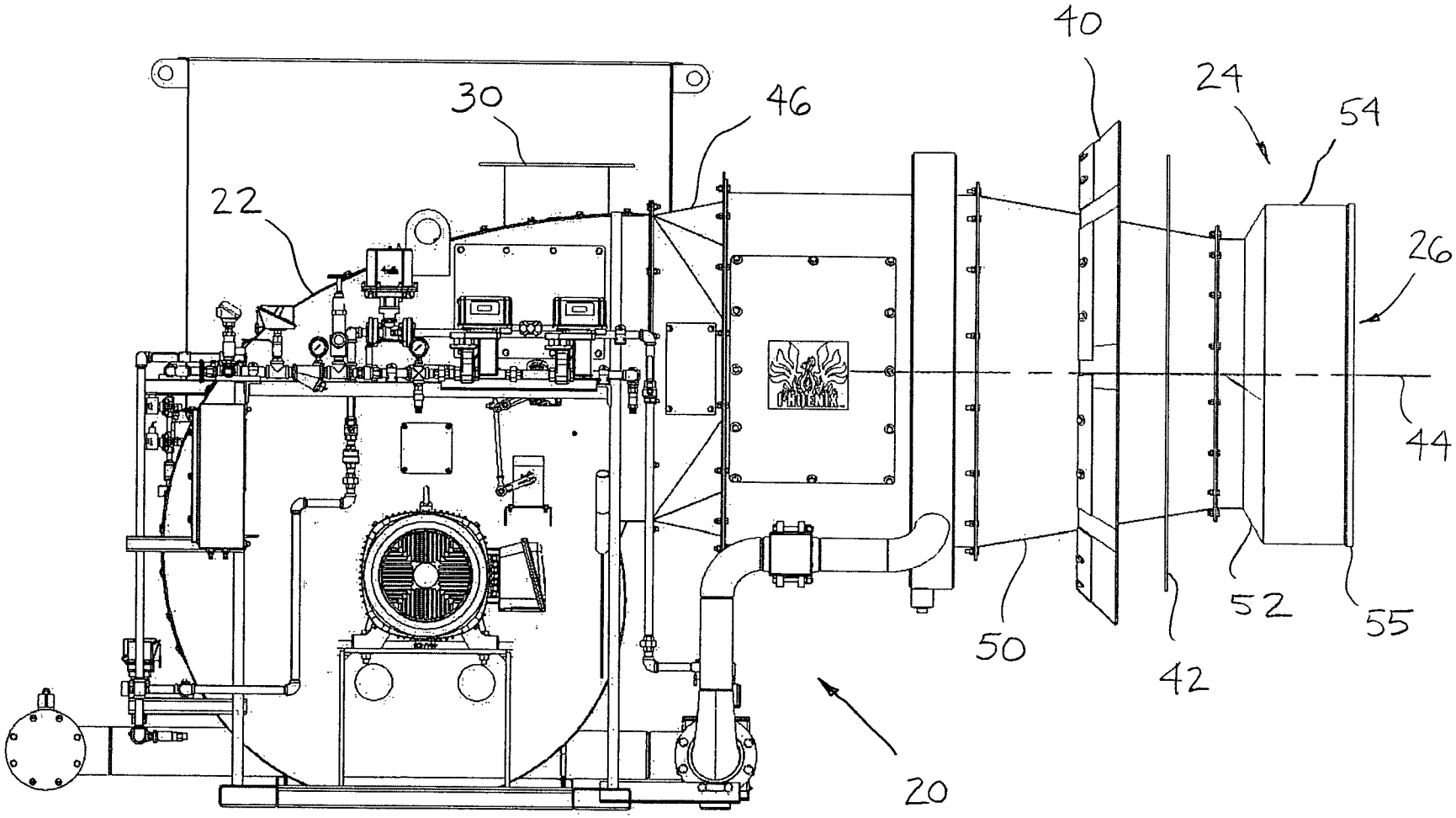
FIG. 2 is a front view of the preferred embodiment of the coal burner assembly illustrated by FIG. 1.

Referring now to FIG. 2, a front view of the preferred coal burner assembly 20 is illustrated. As shown in FIG. 2, preferred coal burner assembly 20 has longitudinal axis 44 which generally extends from the air inlet (see FIG. 6) toward burner end 24. The preferred coal burner assembly 20 also includes transition section 46 which is located downstream from the impeller (see FIG. 6) and adapted to direct air flow from the impeller toward burner end 24. The preferred coal burner assembly 20 further includes cone 50 which is located downstream from the impeller and adapted to direct air flow from the impeller toward burner end 24. The preferred cone 50 has an included angle of approximately 15°. In addition, the preferred coal burner assembly 20 includes flame retention cone 52 which is located in burner end 24. The preferred flame retention cone 52 holds, forms and supports the coal, liquid fuel and gas flames which form inside it. The preferred flame retention cone 52 has a diverging angle of at least approximately 45° relative to longitudinal axis 44 of the burner assembly.

Referring still to FIG. 2, the preferred coal burner assembly 20 also includes cylindrical portion 54 mounted in the burner end and jog 55 mounted on the downstream end of cylindrical portion 54. As discussed in more detail below, the atomizing nozzle, the gas injection nozzles, the bluff bodies and the flame bridges are preferably disposed near the upstream end of cylindrical portion 54. Together, the preferred first bluff body ring 32, the preferred second bluff body ring 34, the preferred third bluff body ring 35, the preferred flame bridge (s) 36, the preferred flame retention cone 52, the preferred cylindrical portion 54 and the preferred jog 55 form, hold and stabilize the main flame by producing eddies within the burner end. Preferably, the base(s) of the flame(s) produced by the coal burner assembly form inside flame retention cone 52 and extend out through opening 26 located at the downstream end of burner end 24.

Figure 3:
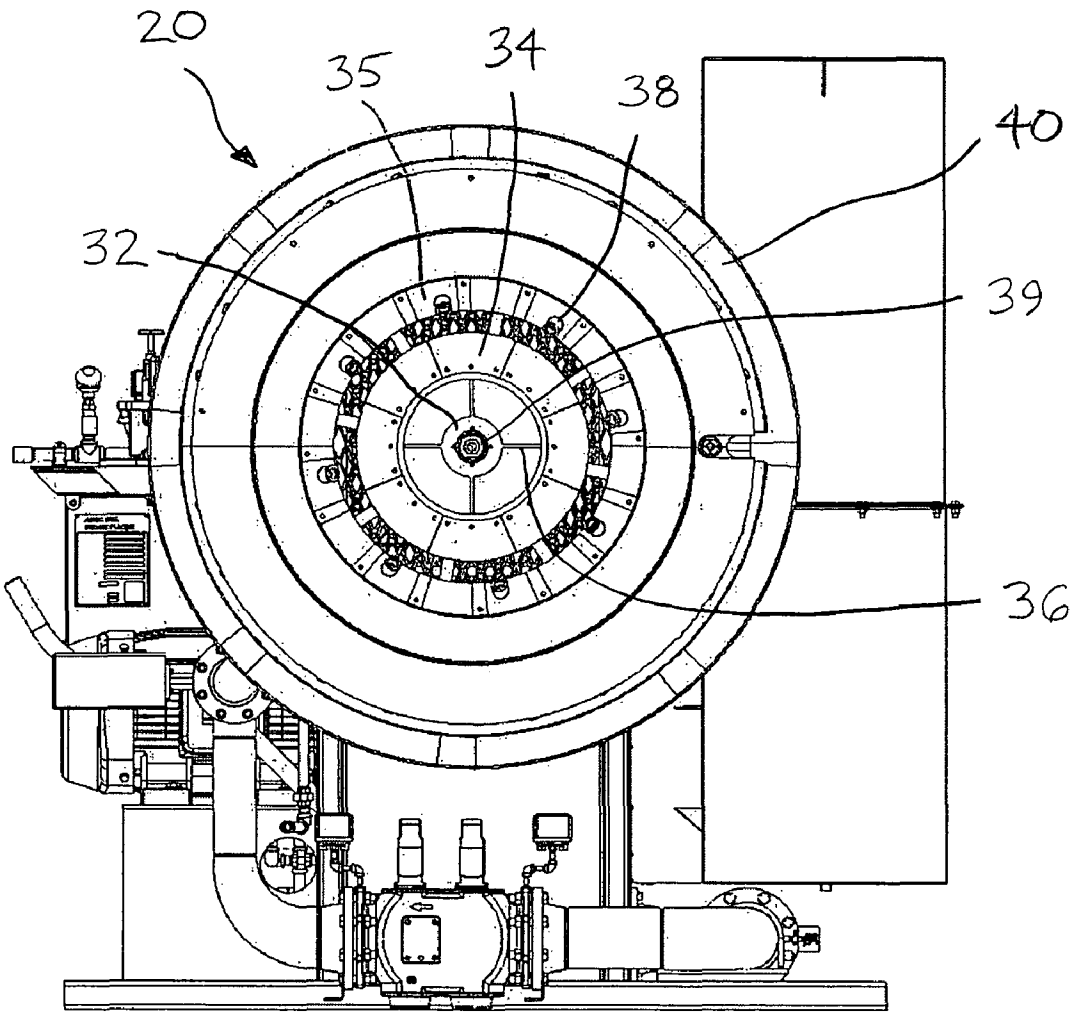
FIG. 3 is a right side view of the preferred embodiment of the coal burner assembly illustrated by FIGS. 1-2.

Referring now to FIG. 3, a right side view of the preferred coal burner assembly 20 is illustrated. As shown in FIG. 3, the preferred coal burner assembly 20 includes first bluff body ring 32. The preferred first bluff body ring 32 is located at burner end 24. The preferred first bluff body ring 32 is relatively small and provides an attachment point for a liquid fuel flame. The preferred first bluff body ring 32 also shapes both the coal and liquid fuel flames. It is contemplated within the scope of the invention that the first bluff body ring 32 may be of any suitable arrangement or configuration adapted to provide an attachment point for the liquid fuel flame and shape the coal and liquid fuel flames. By way of example, and without limitation, it is contemplated within the scope of the invention that first bluff body ring 32 may be a slotted ring, a flapped ring, a castellated ring, a segmented ring or the like.

Referring still to FIG. 3, the preferred coal burner assembly 20 also includes second bluff body ring 34 which is located at burner end 24. The preferred second bluff body ring 34 is adapted to provide main flame shaping and stabilization. The preferred second bluff body ring 34 is also adapted to act as a radiation shield and gas stabilizing surface when the coal burner assembly is firing on gaseous fuel. As shown in FIG. 3, the preferred second bluff body ring 34 is a segmented ring having a plurality of sections that are adapted to tolerate thermal expansion without distorting. The preferred second bluff body ring 34 is also adapted to be easily removed and replaced for purposes such as maintenance, repair, facilitating or modifying flame shaping, material upgrades, and improving flame stabilization. It is contemplated within the scope of the invention that the second bluff body ring may be of any suitable configuration and may be disposed in any suitable arrangement such that it provides main flame shaping and stabilization. By way of example, and without limitation, it is contemplated within the scope of the invention that second bluff body ring 34 may be a contiguous ring, a slotted ring, a flapped ring, a castellated ring or the like.

Still referring to FIG. 3, the preferred coal burner assembly 20 also includes third bluff body ring 35. The preferred third bluff body ring 35 is mounted to the outer burner body at burner end 24 and defines, in part, the combustion air annulus described in detail below (see FIG. 6). The preferred third bluff body ring 35 is adapted to shape the main flame when the assembly is firing on liquid fuel such as oil and shape and retain the main flame when the assembly is firing on gaseous fuel. More particularly, the preferred third bluff body ring 35 is adapted to act as a radiation shield and gas stabilizing surface when the burner assembly is firing on gaseous fuel. The preferred third bluff body ring 35 is a segmented ring. The third bluff body ring 35 is preferably segmented such that the different sections are adapted to tolerate thermal expansion without distorting. The preferred third bluff body ring 35 is also adapted to be easily removed and replaced for purposes such as maintenance, facilitating and modifying flame shaping, material upgrades, and improved flame stabilization. While FIG. 3 illustrates the preferred configuration and arrangement of the third bluff body ring, it is contemplated within the scope of the invention that the third bluff body ring may be of any suitable configuration and arrangement. By way of example, and without limitation, it is further contemplated within the scope of the invention that the third bluff body ring 35 may be a contiguous ring, a slotted ring, a flapped ring, a castellated ring or the like.

Still referring to FIG. 3, the preferred coal burner assembly 20 includes four flame bridges 36. The preferred flame bridges 36 are adapted to transfer the main flame from the first bluff body ring 32 to the second bluff body ring 34. More particularly, the preferred flame bridges 36 are adapted to carry or move the liquid fuel flame outwardly from longitudinal axis 44 and atomizing nozzle 39 toward the coal tube (see FIGS. 4-6) so as to improve main flame stability and combustion quality. The preferred flame bridges 36 are made from metal and are disposed in a generally radial arrangement relative to longitudinal axis 44. The preferred flame bridges 36 extend radially from first bluff body ring 32 toward second bluff body ring 34. As shown in FIG. 3, the preferred second bluff body ring 34 is disposed coaxially with the preferred first bluff body ring 32. In addition, the preferred second bluff body ring 34 has a second bluff body ring diameter, the preferred first bluff body ring 32 has a first bluff body ring diameter and the second bluff body ring diameter is greater than the first bluff body ring diameter. It is contemplated within the scope of the invention, however, that the flame bridges may have any suitable configuration and may be disposed in any suitable arrangement such that they carry the liquid fuel flame toward the coal dust conveyed in the coal tube. It is also contemplated within the scope of the invention that any suitable number of flame bridges may be provided.

Figure 4:
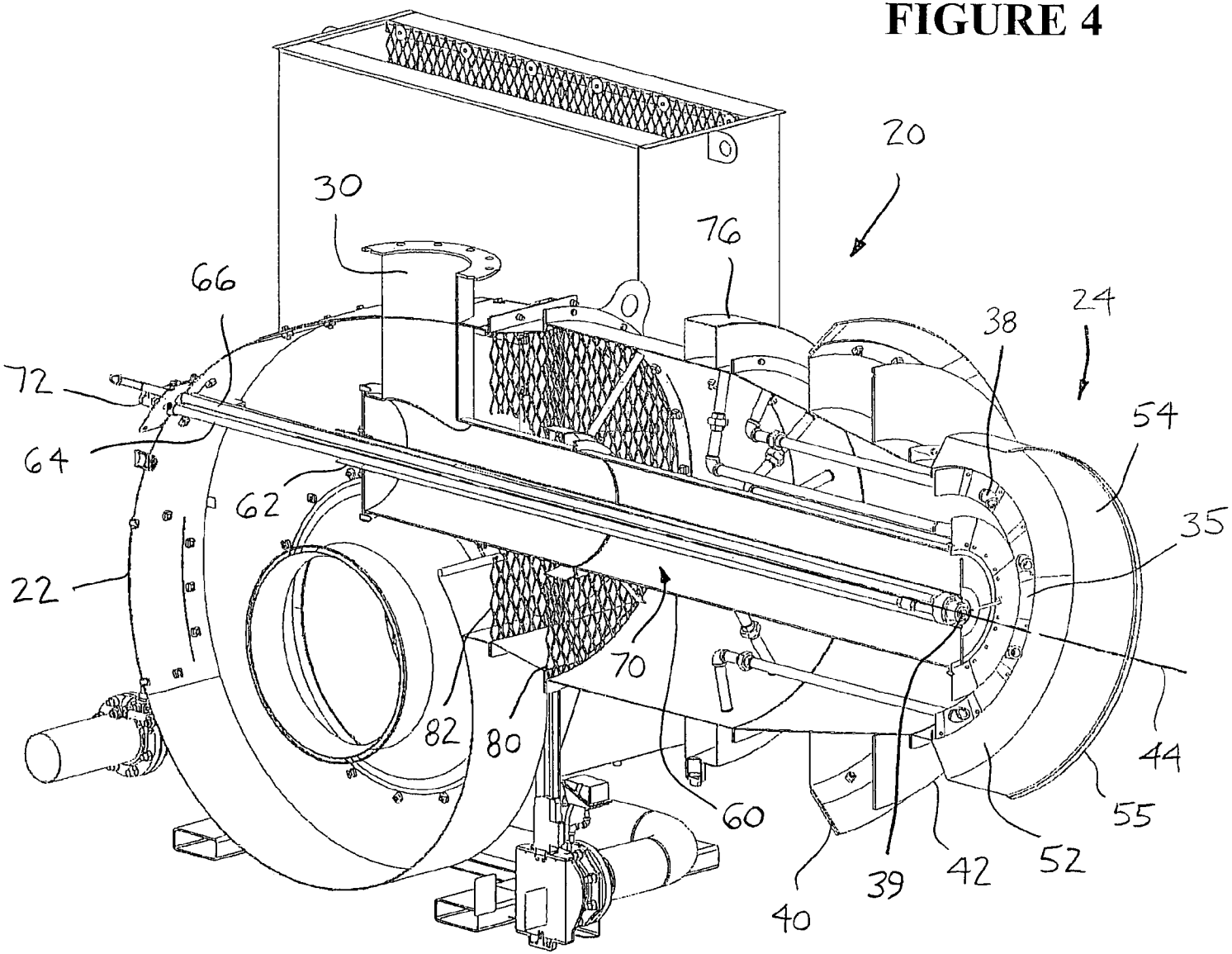
FIG. 4 is a partial sectional perspective view of the preferred embodiment of the coal burner assembly illustrated by FIGS. 1-3.

Referring now to FIG. 4, a partial sectional perspective view of the preferred coal burner assembly 20 is illustrated. As shown in FIG. 4, the preferred coal burner assembly 20 includes coal tube 60 which is disposed generally parallel to longitudinal axis 44 of the burner assembly. Further, the preferred coal inlet 30 is disposed substantially perpendicular to coal tube 60. The preferred coal burner assembly also includes liquid fuel guide tube 62 which is disposed around liquid fuel supply pipe 64 and compressed air supply pipe 66. The preferred coal tube 60 has a larger diameter than the preferred liquid fuel guide tube 62 and is disposed coaxially with the liquid fuel guide tube. In the preferred embodiment of coal burner assembly 20, coal is delivered to the burner end via coal tube 60 in a pulverized state by pneumatic conveyance. As discussed below, a coal preparation system may be used to deliver pulverized coal to coal burner assembly 20. Preferably, the pulverized coal or coal dust is blown into the burner end via coal tube 60 in an appropriate pattern to promote quick and efficient combustion.

Referring still to FIG. 4, the preferred coal inlet 30 and the preferred coal tube 60 are adapted to convey coal toward the burner end of burner assembly 20. More particularly, pulverized coal dust is preferably conveyed toward burner end 24 through coal dust annulus 70 which is defined as the space between the outer surface of liquid fuel guide tube 62 and the inner surface of coal tube 60. While pulverized coal dust is preferably conveyed by coal inlet 30 and coal tube 60 as shown in FIG. 4, it is contemplated within the scope of the invention that the pulverized coal may be delivered by any suitable construction and may follow any suitable path of travel toward the burner end.

In the preferred coal burner assembly 20, a primary air fan (not shown) conveys air through coal inlet 30 and the coal dust annulus 70 of coal tube 60. The preferred primary air fan is not an integral part of coal burner assembly 20 but instead a part of a coal preparation system such as the system described and claimed by U.S. patent application Ser. No. 11/880,234 of Swanson entitled "Apparatus and Method for a Coal Preparation System, the disclosure of which is incorporated herein by reference. However, it is contemplated within the scope of the invention that the primary air fan may be part of coal burner assembly 20. The preferred primary air fan is adapted to deliver primary air to the coal burner assembly whether the burner assembly is firing on coal dust or not. The preferred primary air fan is also adapted to deliver air to the coal burner assembly at different rates using a variable speed drive. It is contemplated within the scope of the invention that the rate at which primary air fan delivers primary air to the burner end may be controlled by any suitable device.

Still referring to FIG. 4, in the preferred embodiments of coal burner assembly 20, liquid fuel such as oil is delivered through fuel valve train 72 and liquid fuel supply pipe 64 to atomizing nozzle 39 where it is sprayed into an appropriate pattern in burner end 24 and burned. The preferred atomizing nozzle 39 is located in the center of burner end 24. More particularly, the preferred atomizing nozzle 39 is located inside liquid fuel guide tube 62. The preferred liquid fuel guide tube 62 provides structural support for the placement of atomizing nozzle 39 and acts as a conduit for a small amount of air which supports the pilot flame and the liquid fuel flame. It is contemplated within the scope of the invention that the liquid fuel guide tube may be any suitable device adapted to support the atomizing nozzle and that the atomizing nozzle may be any suitable device adapted to facilitate the production of a liquid fuel flame.

Referring still to FIG. 4, in the preferred embodiments of coal burner assembly 20, gaseous fuel is delivered through manifold 76 into a system of pipes such as gas injection nozzles 38 located near burner end 24 of the coal burner assembly similar to the gas injection section described in U.S. Pat. No. 6,652,268 of Irwin et al., the disclosure of which is incorporated herein by reference. As shown in FIG. 4, the preferred gas injection nozzles 38 are disposed within third bluff body ring 35. It is contemplated with in the scope of the invention, however, that any suitable arrangement and configuration may be used to deliver gaseous fuel to the coal burner assembly.

Further, the preferred embodiment of coal burner assembly 20 is adapted to produce a stabilizing gas base flame by delivering a relatively small amount of gaseous fuel to atomizing nozzle 39 when the coal burner assembly is firing on gaseous fuel via gas injection nozzles 38 similar to the stabilizing gas base flame system described and claimed in pending U.S. patent application Ser. No. 11/208,674 of Swanson, the disclosure of which is incorporated herein by reference. Preferably, coal burner assembly 20 produces a stabilizing gas base flame when it is operating in the range of about thirty percent (30%) of total capacity or lower. It is contemplated within the scope of the invention, however, that the preferred coal burner assembly 20 may be adapted to produce a stabilizing gas base flame by delivering a relatively small amount of gaseous fuel to atomizing nozzle 39 when the coal burner assembly is firing in any range of its total capacity. It is further contemplated that the atomizing nozzle of the preferred coal burner assembly may be adapted to receive more or less than a relatively small amount of gaseous fuel over the entire range of operation of the burner assembly.

Still referring to FIG. 4, the preferred coal burner assembly 20 includes a pair of screens 80 and 82. The preferred screens 80 and 82 are mounted in the housing of the burner assembly downstream from the impeller and adapted to straighten air flow in the coal burner assembly. While FIG. 4 illustrates the preferred coal burner assembly 20 having two screens, it is contemplated within the scope of the invention that the coal burner assembly may have more or fewer than two screens, and that the screen(s) may be of any suitable configuration and arrangement. It is also contemplated within the scope of the invention that the preferred coal burner assembly may include a straightening screen adapted to produce a uniform air flow velocity in the burner assembly and/or a mixing screen adapted to produce a uniform air flow velocity in the burner assembly and mix combustion air and fuel in the burner assembly.

Figure 5:
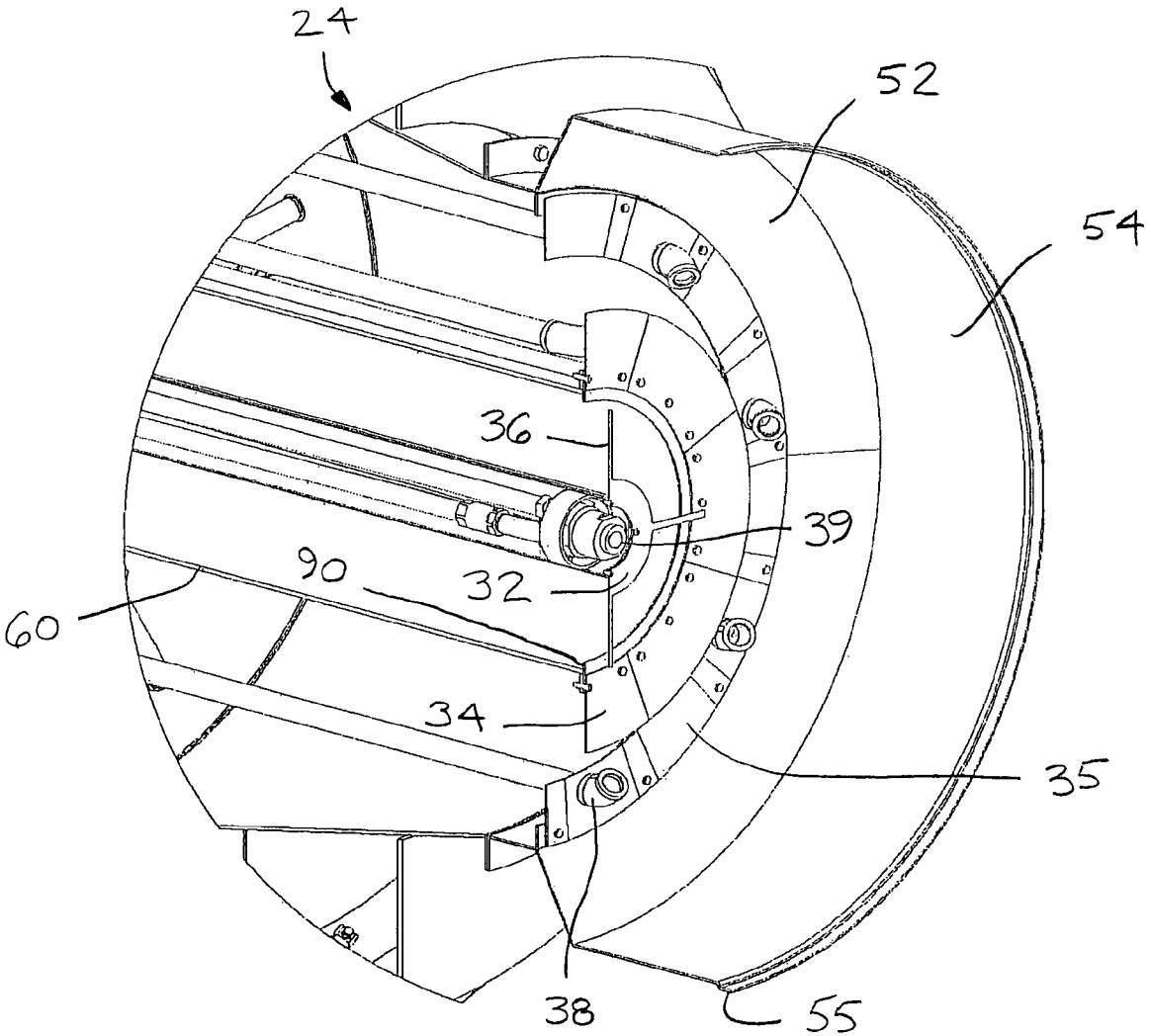
FIG. 5 is a partial sectional perspective view of the preferred burner end of the coal burner assembly illustrated by FIGS. 1-4.

Referring now to FIG. 5, a partial sectional perspective view of the preferred burner end 24 of coal burner assembly 20 is illustrated. As shown in FIG. 5, the preferred coal burner assembly 20 includes first bluff body ring 32, second bluff body ring 34, third bluff body ring 35, flame bridges 36, gas injection nozzles 38, atomizing nozzle 39, flame retention cone 52, cylindrical portion 54 and jog 55. As also shown in FIG. 5, the preferred coal burner assembly 20 includes coal tube band 90. The preferred coal tube band 90 is disposed on the inner diameter of coal tube 60 in burner end 24 and adapted to improve the stability and quality of the liquid fuel flame. More particularly, the preferred coal tube band 90 is adapted to produce an eddy downstream from the band. The preferred coal tube band 90 is an approximately ⅜" smooth ring, but it is contemplated within the scope of the invention that the coal tube band may be of any suitable configuration and arrangement.

Figure 6:
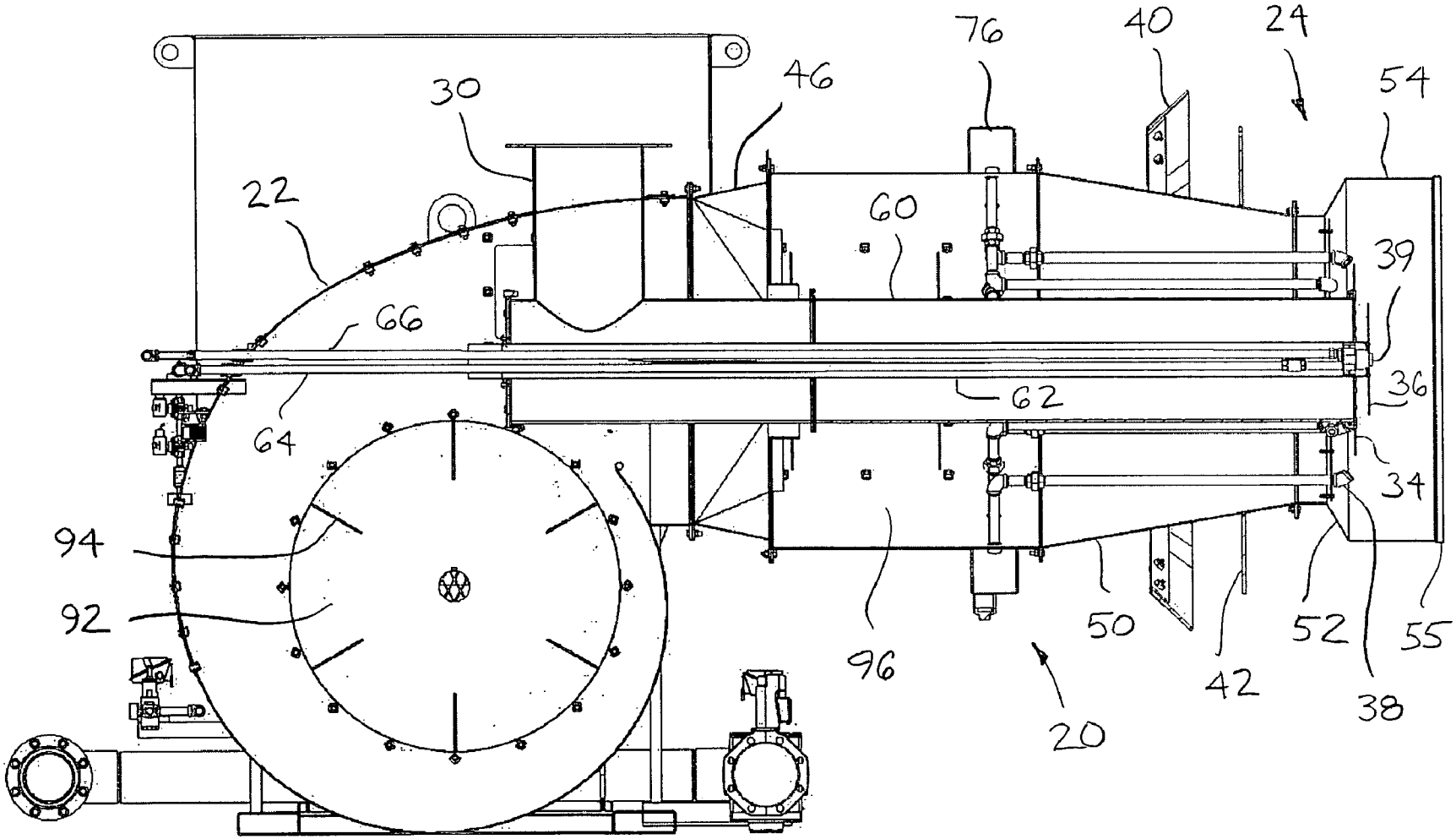
FIG. 6 is a partial sectional front view of the preferred embodiment of the coal burner assembly illustrated by FIGS. 1-5.

Referring now to FIG. 6, a partial sectional front view of the preferred coal burner assembly 20 is illustrated. As shown in FIG. 6, the preferred coal burner assembly 20 includes air inlet 92 and a secondary fan including impeller 94. The preferred impeller 94 is mounted in housing 22 and is in fluid communication with air inlet 92 and operatively connected to motor 28. The preferred impeller 94 is adapted to direct air from air inlet 92 toward burner end 24. More particularly, the preferred impeller 94 is adapted to deliver combustion air to combustion air annulus 96. The preferred combustion air annulus 96 is defined by the space between the outer surface of coal tube 60 and the inner surface of housing 22. The preferred impeller 94 is an integral component of the coal burner, but it is contemplated within the scope of the invention that the impeller may be a separate component or part of a coal preparation system. The preferred impeller 94 is controlled by a variable speed drive, but it is contemplated within the scope of the invention that the impeller may be controlled by any suitable device. It is also contemplated within the scope of the invention that combustion air may be delivered to the coal burner assembly using more or fewer than two fans or impellers or by any other suitable device adapted to deliver air.

It is contemplated within the scope of the invention that alternative embodiments of the coal burner assembly may include a plurality of spin vanes. The preferred spin vanes are located downstream from the impeller and upstream from the burner end. The preferred spin vanes are disposed in a radial arrangement relative to the longitudinal axis of the burner assembly and may be controlled and adjusted using a burner control system.

Figure 7A:
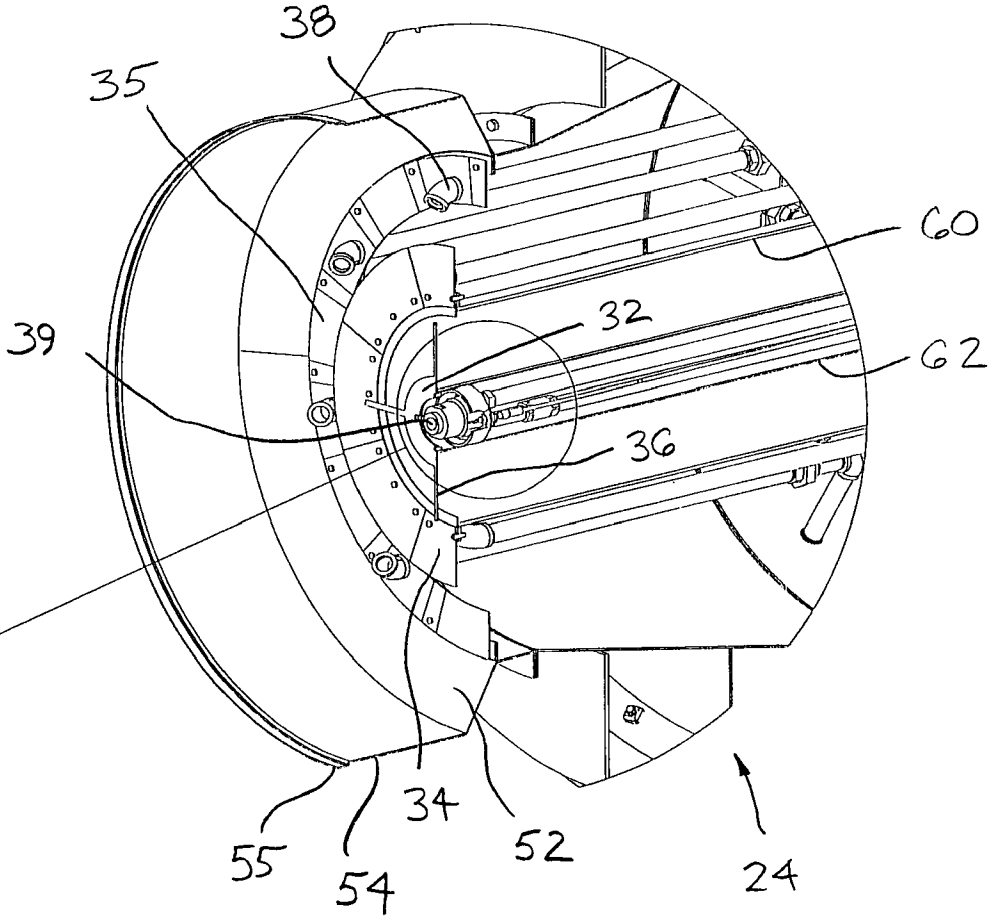
FIG. 7A is a partial sectional perspective view of the preferred burner end of the coal burner assembly illustrated by FIGS. 1-6.
Figure 7B:
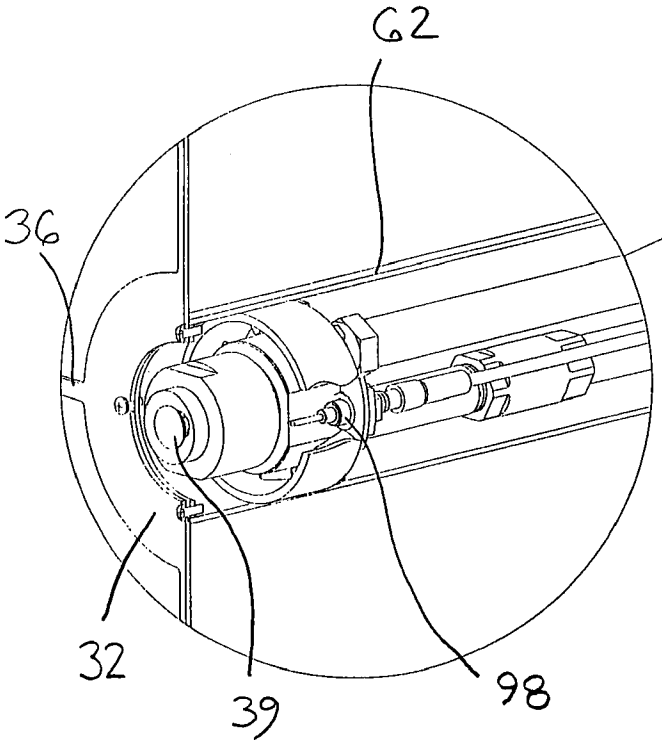
FIG. 7B is an enlarged partial sectional perspective view of the preferred liquid fuel assembly of the coal burner assembly illustrated by FIG. 7A.

Referring now to FIG. 7A, a partial sectional perspective view of the preferred burner end 24 of coal burner assembly 20 is illustrated. As shown in FIG. 7A, the preferred burner end includes first bluff body ring 32, second bluff body ring 34, third bluff body ring 35, flame bridges 36, gas injection nozzles 38, atomizing nozzle 39, flame retention cone 52, cylindrical portion 54, jog 55, coal tube 60 and liquid fuel guide tube 62. FIG. 7B illustrates an enlarged view of the liquid fuel assembly shown in FIG. 7A. More particularly, as shown in FIG. 7B, the preferred coal burner assembly 20 includes igniter 98 which is mounted in burner end 24 and adapted to ignite the air and fuel mixture in the burner end to produce the main flame.

In operation, several advantages of the preferred embodiments of the invention are achieved. For example, the preferred embodiments of the coal burner assembly are adapted for use in connection with the production of hot mix asphalt. In the preferred embodiments of the coal burner assembly, pulverized coal preferably enters the coal burner assembly through a large flange in the top of the housing. The pulverized coal preferably travels initially in a direction generally perpendicular to and toward the longitudinal axis of the coal burner assembly and then in a direction generally parallel to the longitudinal axis and toward the burner end. By injecting the coal into the coal burner assembly in this manner wear to the components of the burner assembly is minimized. In addition, the preferred embodiments of the coal burner assembly do not produce a swirl within the housing. As a result, the preferred embodiments of the coal burner assembly uniformly mix air and coal dust, produce a stable main flame, and further minimize wear to the components of the burner assembly.

What is claimed is:

1. A burner assembly comprising:

(a) a housing having an air inlet;

(b) a burner end having an opening;

(c) a longitudinal axis, said longitudinal axis extending generally from the air inlet toward the burner end;

(d) a motor;

(e) an impeller mounted in the housing, said impeller being in fluid communication with the air inlet, operatively connected to the motor and adapted to direct air from the air inlet towards the burner end;

(f) a coal tube, said coal tube being adapted to convey coal toward the burner end;

(g) a coal inlet, said coal inlet being adapted to convey coal to the coal tube;

(h) a first bluff body ring, said first bluff body ring being mounted at the burner end;

(i) a second bluff body ring, said second bluff body ring being mounted at the burner end;

(j) a third bluff body ring, said third bluff body ring being mounted at the burner end;

(k) at least one flame bridge; said at least one flame bridge being disposed between the first bluff body ring and the second bluff body ring; and (l) an igniter mounted in the burner end, said igniter being adapted to ignite the air and fuel mixture in the burner end to produce a main flame.

2. The burner assembly of claim 1 wherein the coal tube is disposed generally parallel to the longitudinal axis of the burner assembly.

3. The burner assembly of claim 1 wherein the coal inlet is disposed substantially perpendicular to the coal tube.

4. The burner assembly of claim 1 wherein the second bluff body ring is disposed coaxially with the first bluff body ring.

5. The burner assembly of claim 1 wherein the second bluff body ring has a second bluff body ring diameter, the first bluff body ring has a first bluff body ring diameter and the second bluff body ring diameter is greater than the first bluff body ring diameter.

6. The burner assembly of claim 1 wherein the at least one flame bridge extends radially from the first bluff body ring toward the second bluff body ring.

7. The burner assembly of claim 1 wherein the at least one flame bridge is adapted to transfer the main flame from the first bluff body ring to the second bluff body ring.

8. The burner assembly of claim 1 further comprising a flame retention cone.

9. The burner assembly of claim 8 wherein the flame retention cone has a diverging angle of at least approximately 45° relative to the longitudinal axis of the burner assembly.

10. The burner assembly of claim 1 further comprising a cylindrical portion mounted in the burner end.

11. The burner assembly of claim 10 wherein the cylindrical portion includes a jog.

12. The burner assembly of claim 1 further comprising a liquid fuel guide tube, said liquid fuel guide tube being adapted to convey liquid fuel toward the burner end.

13. The burner assembly of claim 12 wherein the coal tube is disposed generally coaxially with the liquid fuel guide tube.

14. The burner assembly of claim 12 wherein an atomizing nozzle is provided on the liquid fuel guide tube in the burner end.

15. The burner assembly of claim 1 further comprising at least one gas injection nozzle mounted in the burner end, each of said at least one gas injection nozzles being adapted to direct gaseous fuel into the burner end.

16. The burner assembly of claim 1 further comprising at least one screen.

17. The burner assembly of claim 1 further comprising a coal tube band.

18. A burner assembly, said burner assembly comprising:

(a) a housing having an air inlet;

(b) a burner end having an opening;

(c) a longitudinal axis, said longitudinal axis extending generally from the air inlet toward the burner end;

(d) a motor;

(e) an impeller mounted in the housing, said impeller being in fluid communication with the air inlet, operatively connected to the motor and adapted to direct air from the air inlet towards the burner end;

(f) at least one gas injection nozzle mounted in the burner end, each of said at least one gas injection nozzles being adapted to direct gaseous fuel into the burner end;

(g) a liquid fuel guide tube, said liquid fuel guide tube being adapted to convey liquid fuel toward the burner end;

(h) a coal tube, said coal tube being adapted to convey coal toward the burner end;

(i) a coal inlet, said coal inlet being adapted to convey coal to the coal tube;

(j) a first bluff body ring, said first bluff body ring being mounted at the burner end;

(k) a second bluff body ring, said second bluff body ring being mounted at the burner end;

(l) a third bluff body ring, said third bluff body ring being mounted at the burner end;

(m) at least one flame bridge; said at least one flame bridge being disposed between the first bluff body ring and the second bluff body ring;

(n) a flame retention cone, said flame retention cone being mounted in the burner end;

(o) a cylindrical portion, said cylindrical portion being mounted in the burner end and having a jog;

(p) at least one screen, said at least one screen being mounted in the housing;

(q) a coal tube band; said coal tube band being mounted on the coal tube in the burner end; and (r) an igniter mounted in the burner end, said igniter being adapted to ignite the air and fuel mixture in the burner end to produce a main flame;

wherein the burner assembly is adapted to selectively fire on gaseous fuel, liquid fuel, coal and any combination thereof.

19. The burner assembly of claim 18 wherein the coal inlet is disposed substantially perpendicular to the coal tube, and the coal tube is disposed substantially parallel to the longitudinal axis of the burner assembly.

20. The burner assembly of claim 18 wherein the at least one flame bridge extends radially from the first bluff body ring toward the second bluff body ring.

* * * * *